US011619106B2

(12) United States Patent
Coles

(10) Patent No.: US 11,619,106 B2
(45) Date of Patent: Apr. 4, 2023

(54) TOOL BRAKE

(71) Applicant: Halliburton Energy Services, Inc., Houston, TX (US)

(72) Inventor: Randolph Scott Coles, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 136 days.

(21) Appl. No.: 17/052,357

(22) PCT Filed: Aug. 28, 2018

(86) PCT No.: PCT/US2018/048316
§ 371 (c)(1),
(2) Date: Nov. 2, 2020

(87) PCT Pub. No.: WO2020/046281
PCT Pub. Date: Mar. 5, 2020

(65) Prior Publication Data

US 2021/0115744 A1 Apr. 22, 2021

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 40/001; E21B 33/134; E21B 33/12
See application file for complete search history.

(56) References Cited

U.S. PATENT DOCUMENTS 2,678,101 A * 5/1954 Thaxton ..... E21B 23/06 166/134
5,353,872 A * 10/1994 Wittrisch ..... E21B 23/01 175/50
5,409,060 A * 4/1995 Carter ..... E21B 10/60 166/241.1
9,217,305 B2 * 12/2015 Coles ..... E21B 47/09
9,976,407 B2 * 5/2018 Ash ..... E21B 47/01
(Continued)

FOREIGN PATENT DOCUMENTS

WO 2010036236 A1 4/2010
WO 2011037581 A1 3/2011

OTHER PUBLICATIONS

International Search Report and Written Opinion dated May 24, 2019; International PCT Application No. PCT/US2018/048316.

*Primary Examiner* — Steven A MacDonald
(74) *Attorney, Agent, or Firm* — Barnes & Thornburg, LLP

(57) ABSTRACT

A tool brake is provided for use in horizontal wells that is positionable between a setting tool and a setting sleeve in combination with a tool string. Upon activation of the setting tool to set a bridge plug in a well, the normal action of the setting tool causes activation of the tool brake that extends one or more arms from the tool brake to exert pressure against the wellbore casing of the well. The tool brake prevents reverse slippage caused by gravity's pull of the tool string in a horizontal well permitting accurate placement of downhole tools such as perforating guns. Moreover, inadvertent cutting of a cable that retrieves the downhole tools can be prevented such as due to slippage of downhole tools over-lapping the cable before perforating guns are detonated.

19 Claims, 7 Drawing Sheets

(56) References Cited

U.S. PATENT DOCUMENTS

| | | | | |
|---|---|---|---|---|
| 2002/0104686 | A1* | 8/2002 | Bloom | E21B 23/00 166/212 |
| 2004/0011533 | A1* | 1/2004 | Lawrence | E21B 23/04 166/212 |
| 2005/0263280 | A1* | 12/2005 | Sellers | E21B 47/09 166/301 |
| 2009/0071659 | A1 | 3/2009 | Spencer et al. | |
| 2009/0071660 | A1* | 3/2009 | Martinez | E21B 23/01 166/216 |
| 2011/0073326 | A1 | 3/2011 | Clemens et al. | |
| 2011/0127044 | A1* | 6/2011 | Radford | E21B 47/12 166/212 |
| 2014/0262343 | A1* | 9/2014 | Larsen | E21B 33/1293 166/382 |
| 2015/0285017 | A1* | 10/2015 | Coles | G01V 11/005 166/382 |
| 2016/0084079 | A1 | 3/2016 | Zhou | |
| 2017/0058631 | A1* | 3/2017 | Fitzhugh | E21B 33/128 |
| 2021/0108474 | A1* | 4/2021 | Al Hussin | E21B 33/129 |

* cited by examiner

TOOL BRAKE

BACKGROUND

Field of the Disclosure

The present disclosure relates generally to reducing tool slippage after setting a bridge plug, and more specifically to providing a tool brake for reducing tool slippage after setting a bridge plug in a horizontal well.

Related Art

During drilling and operations for hydrocarbon production within a horizontally oriented well in a geological formation, tools being used during the completion of the well can be subject to slippage in a reverse manner due to the gravitational pull being exerted on the tool assembly. This is often due to the modest inclination or rise in elevation of the horizontal portion of the wellbore. This tendency for downhole tools, such as, e.g., perforating guns, to slip backwardly along the wellbore due to the pull of gravity can be problematic for accurately locating and maintaining downhole tools at a proper location within the wellbore. This slippage can lead to operations such as perforating operations at a wrong depth or location.

BRIEF DESCRIPTION OF THE DRAWINGS

Illustrative embodiments of the present disclosure are described in detail below with reference to the attached drawing figures, which are incorporated by reference herein, and wherein.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

As used herein, the singular forms "a", "an," and "the" are intended to include the plural forms as well, unless the context clearly indicates otherwise. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The present disclosure relates generally to accurate placement and maintaining of a position of downhole tools within a wellbore. More particularly, the present disclosure relates to providing a tool brake for reducing tool slippage after setting a bridge plug for countering slippage of downhole tools within a wellbore, particularly a horizontal wellbore, in any type of subterranean formation.

Figure 1:
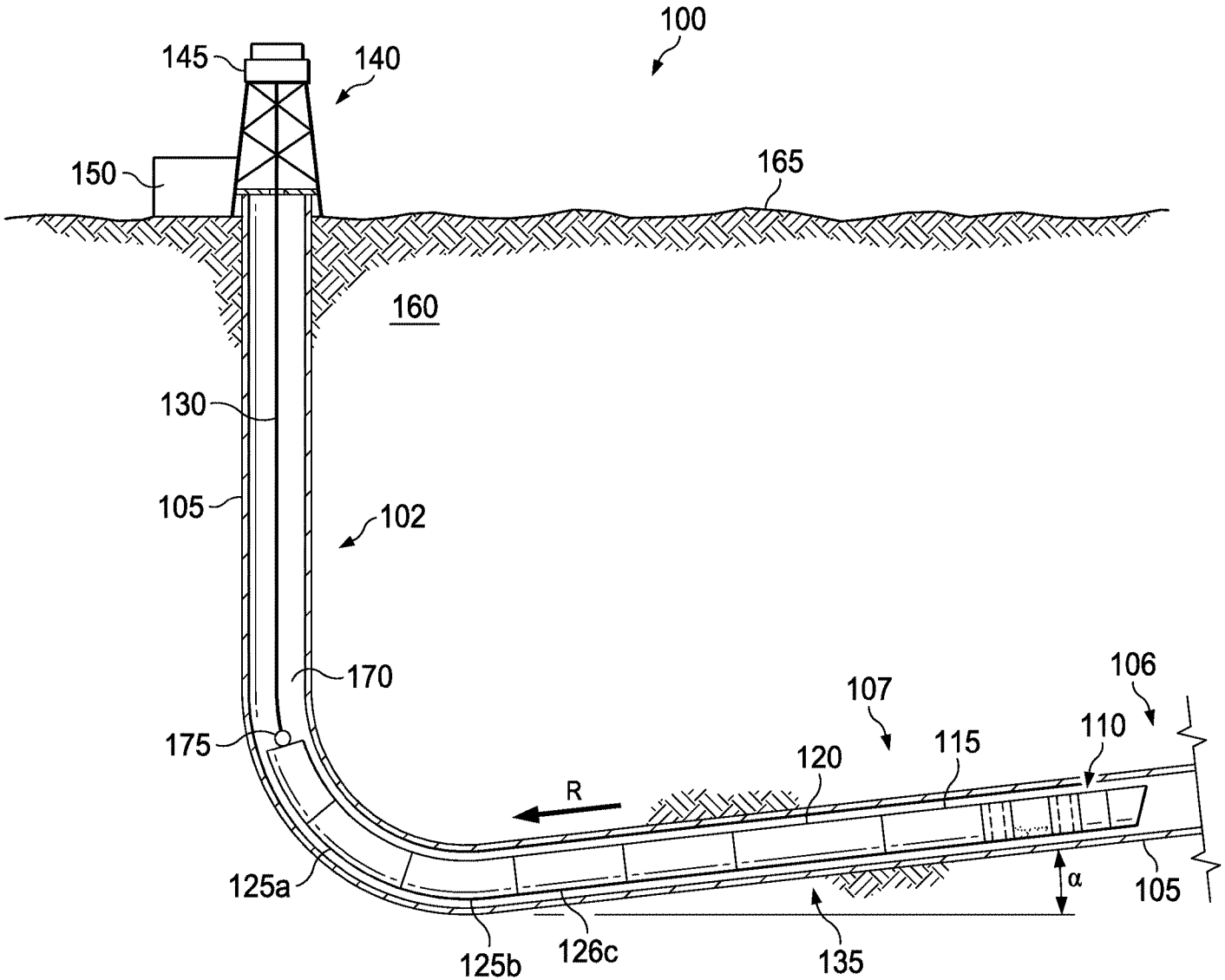
FIG. 1 is a schematic view of a drilling system and tool string within a horizontal well.

Referring to FIG. 1, an illustration of an example drilling system 100 and tool string 135 within a well 102 in accordance with the prior art is illustrated. The drilling system 100 includes a drilling rig 140, a hoisting and lowering mechanism 145 and one or more pumps 150 for pumping one or more fluids 170 downhole in wellbore casing 105. Downhole being a direction towards the distal end 106. The drilling rig 140, the hoisting and lowering mechanism 145 and the one or more pumps 150 are located at a surface 165. Other components may be included in the drilling system 100 as needed.

During well operations, such as a plug and perforate operation, a tool string 135 may be pushed along the wellbore casing 105 in a geological formation 160 by fluids 170 under pressure provided by the one or more pumps 150. A cable 130 is attached to the tool string 135 at connecting point 175 and to the hoisting and lowering mechanism 145 at the surface 165. The location of the tool string 135 may be known at least in part by the length of cable from a known location at the surface to connecting point 175. The length of each component of the tool string 135 is also known providing a location of each component within the wellbore casing 105.

The tool string 135 in the example of FIG. 1 includes a plurality of perforating guns 125*a*-125*c*, a bridge plug setting tool 120, a setting sleeve 115 and a bridge plug 110 positioned mostly along the horizontal portion 107 of the wellbore casing 105. The geometry of the well 102 includes a horizontal portion 107 that is shown with a modest rise in elevation to horizontal indicated by the character a. In a traditional plug and perforate operation, the bridge plug 110 may be set by the setting tool 120 via setting sleeve 115. Once the bridge plug 110 is set and released from the tool string 135, the plurality of perforating guns 125*a*-125*c* may be relocated by retracting the cable 130 until a desired location is reached by the plurality of perforating guns 125*a*-125*c* along the wellbore casing 105. However, in some operational instances, due to gravity, perforating guns 125*a*-125*c* may slide in reverse within the wellbore casing 105, indicated by arrow R, faster than the cable 130 is being pulled out of the wellbore casing 105. This can result in the plurality of perforating guns 125*a*-125*c* being placed at an incorrect location or depth in wellbore casing 105. In a worse type case, the perforating guns 125*a*-125*c* can also slide past the cable 130 in direction R, and the cable 130 can be severed when the perforating guns are fired to create perforations in the wellbore casing 105 in preparation for hydrocarbon production from geological formation 160. A severed cable 130 can prevent the plurality of perforating guns 125*a*-125*c* from being removed from the well.

Figure 2:
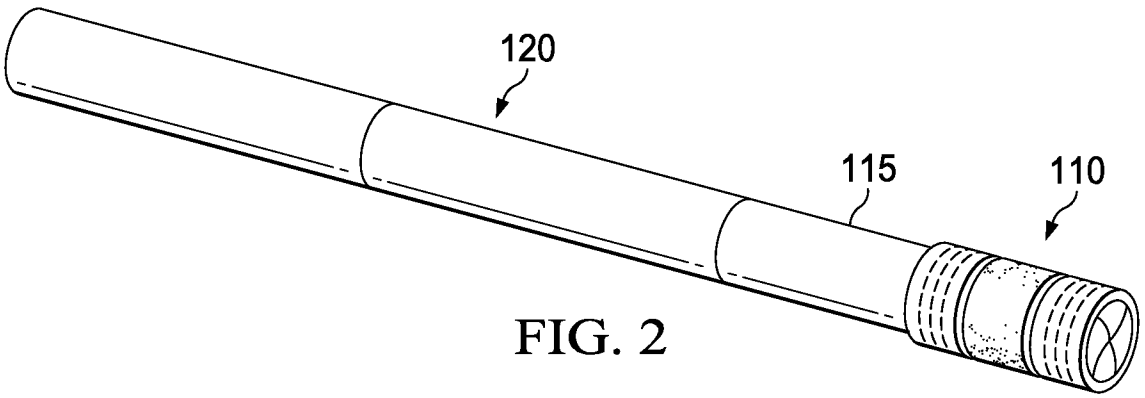
FIG. 2 is an illustration of an example bridge plug assembly comprising the setting tool and bridge plug of FIG. 1.

FIG. 2 is an illustration of an example bridge plug assembly comprising the setting tool and bridge plug of FIG. 1. The setting tool 120 is shown coupled to a setting sleeve 115 which is coupled to the bridge plug 110.

Figure 3:
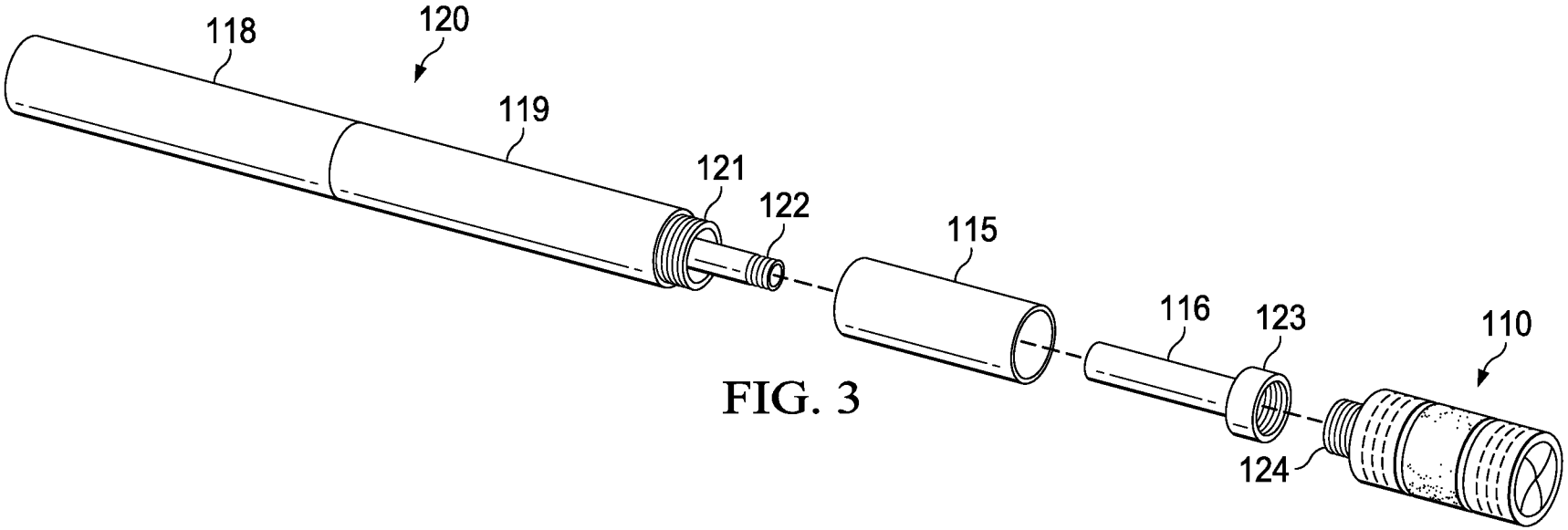
FIG. 3 is an exploded view of the bridge plug assembly of FIG. 2.
Figure 4:
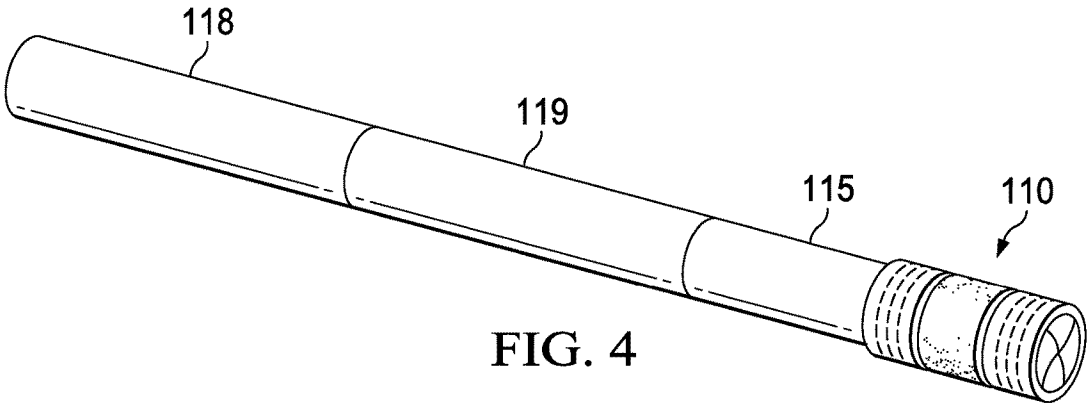
FIG. 4 is an illustration of the reassembled bridge plug assembly of FIG. 3.

FIG. 3 is an exploded view of the bridge plug assembly of FIG. 2. The setting tool 120 may comprise an upper section 118 and a lower section 119. The setting sleeve 115 may attach to the lower section 119 of the setting tool 120 via connecting mechanism 121 which may be a threaded connecting mechanism. The setting tool 120 connects with a bridge plug adaptor 116 via a second connecting mechanism 122 which may be a threaded connecting mechanism. The setting sleeve 115 is configured to permit the bridge plug adaptor 116 to be inserted through the setting sleeve 115 as shown. The bridge plug adaptor 116 is configured with a third connecting mechanism 123 for attaching to the bridge plug 110 such as at connecting end 124 which may be a threaded connection. FIG. 4 is an illustration of the reassembled bridge plug assembly of FIG. 3.

Figure 5:
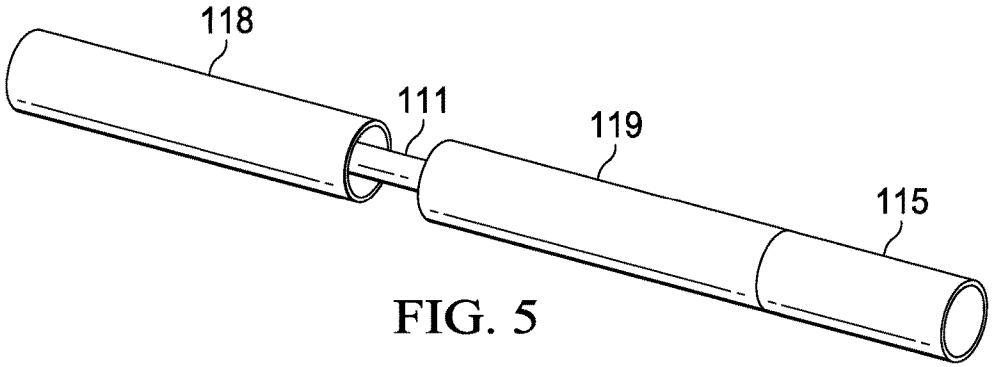
FIG. 5 illustrates the motion of the lower section of the setting tool when a bridge plug is set in a well bore casing.

FIG. 5 illustrates the motion of the lower section 119 of the setting tool 120 when a bridge plug is set in a casing 105. Piston 111 extends from the upper section 118 to push the lower section 119 and setting sleeve 115 against the bridge plug 110. The piston may operate due to sufficient hydraulic pressure applied from equipment at the surface 165. This action causes the bridge plug to expand against the wellbore casing 105 and severs the bridge plug 110 from the tool string 135.

Figure 6:
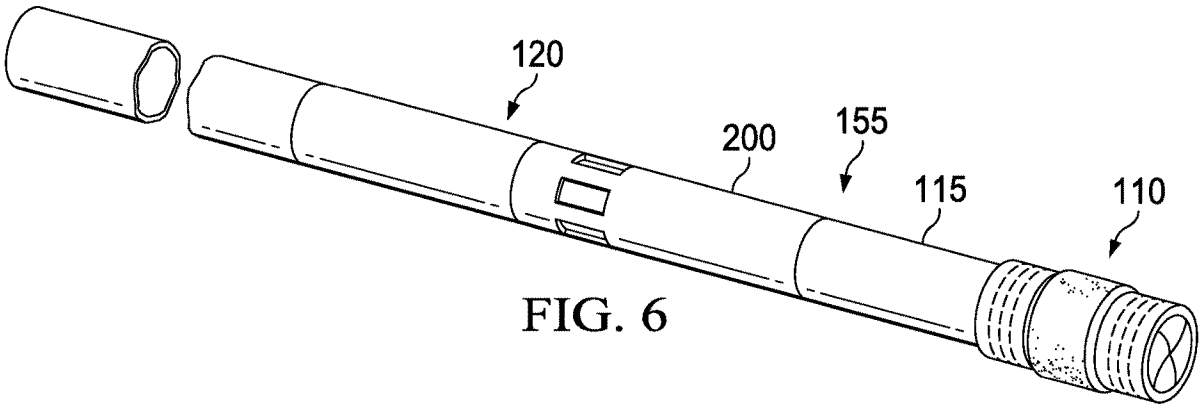
FIG. 6 is an illustration of a bridge plug assembly that includes a tool brake, according to principles of the disclosure.
Figure 11:
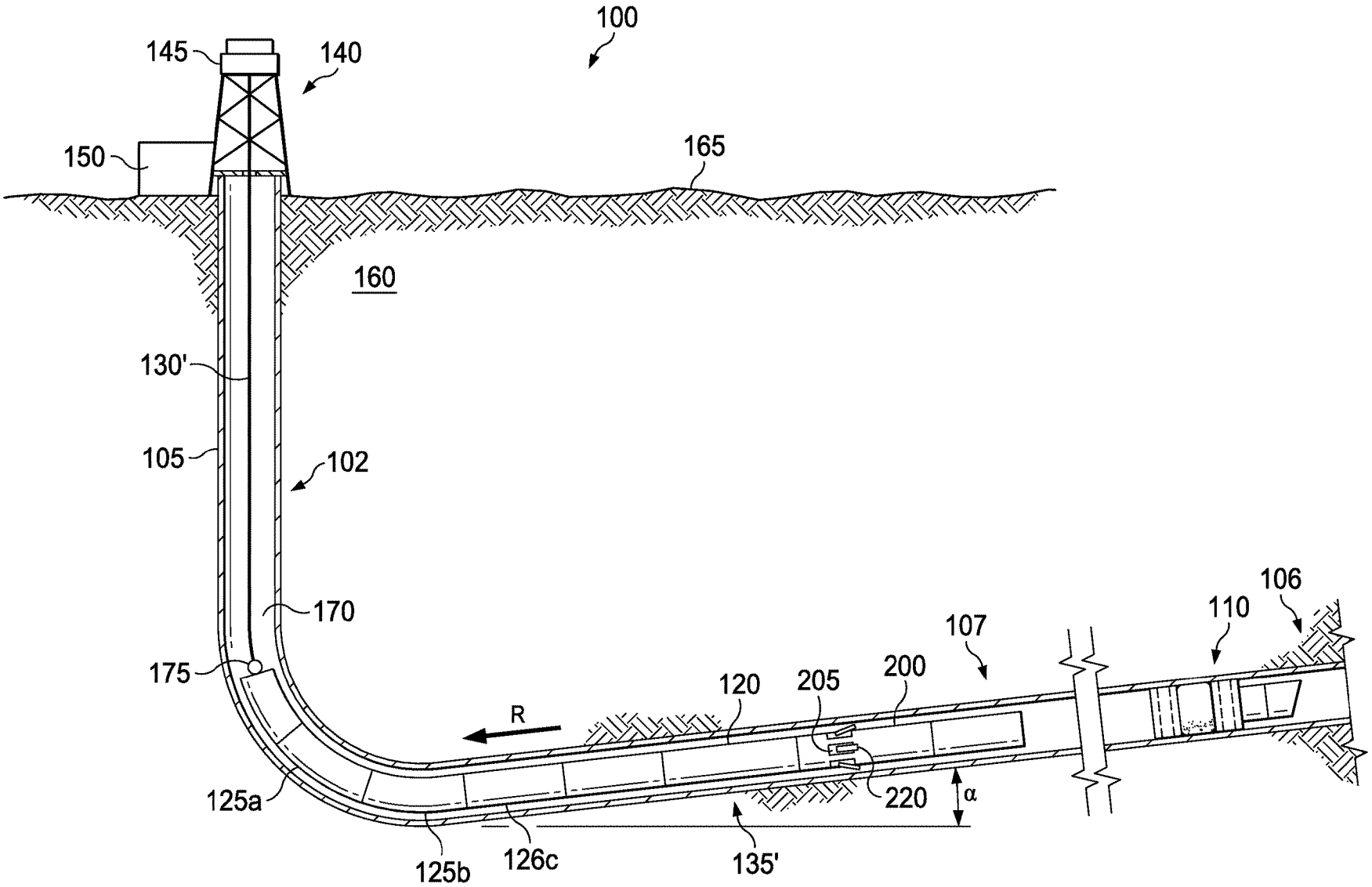
FIG. 11 is an illustration of an example drilling system including tool string within a horizontal well, according to principles of the disclosure.

FIG. 6 is an illustration of a bridge plug assembly 155 that includes a tool brake 200, according to principles of the disclosure. The tool brake 200 is also shown as part of the tool string 135' (FIG. 11). The tool brake 200 is adapted to be configured between the setting tool 120 and setting sleeve 115 while taking advantage of the operational features of the setting tool 120, as described more fully below. The tool brake 200 provides for engaging with the wellbore casing 105 at a particular location to prevent slippage of a tool string after a bridge plug 110 set in the wellbore casing 105. The tool brake 200 when activated, as described more below, to engages the wellbore casing 105 and inhibits reverse movement in direction R (FIG. 11) to prevent slippage of one or more tools, such as perforating guns 125*a*-125*c*, thereby accurately placing and maintaining a desired location within the wellbore casing 105 of the one or more tools. The tool brake 200 when activated to engage the wellbore casing 105 counteracts gravity's pull in direction R (FIG. 11).

Figure 7:
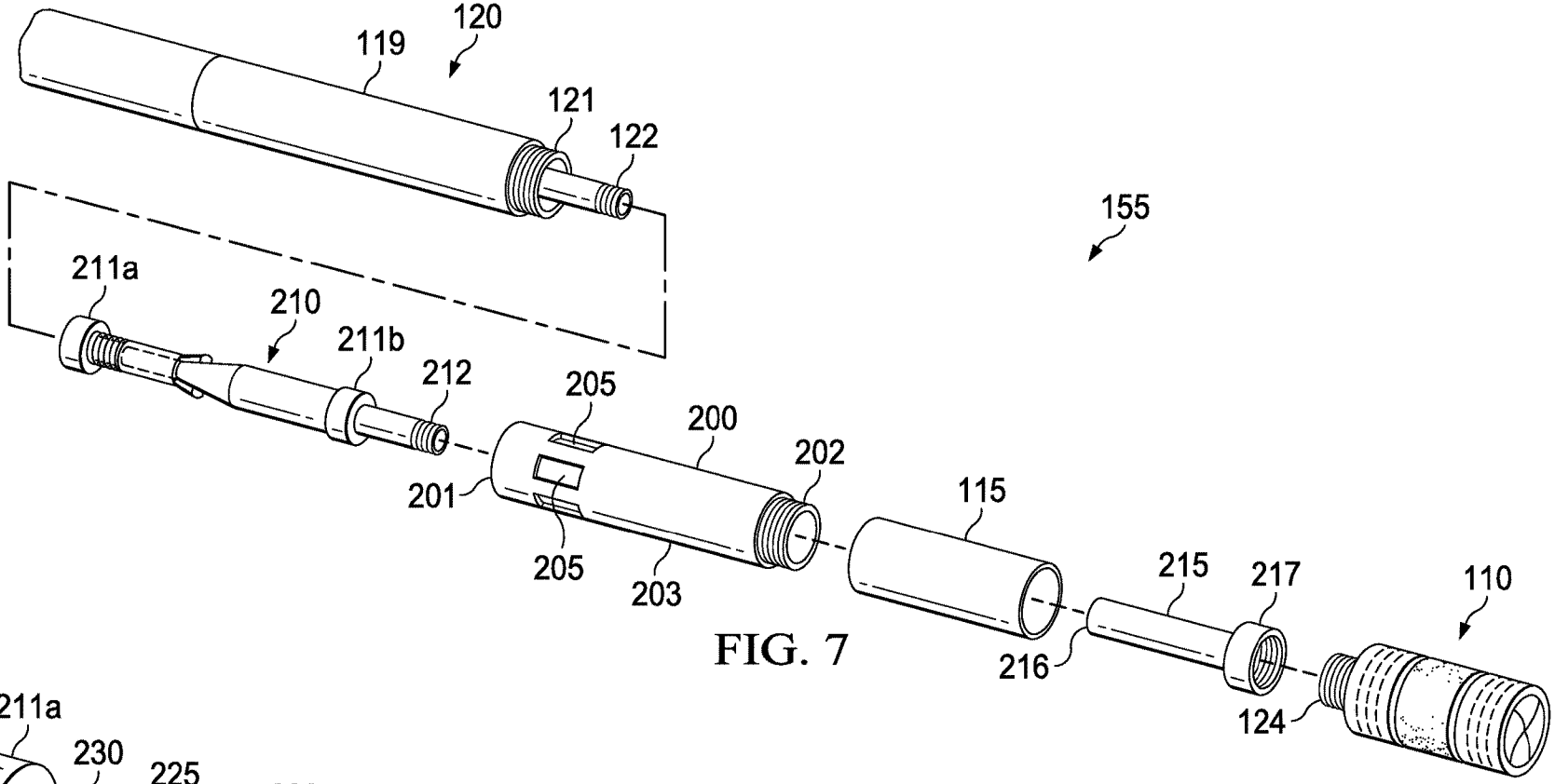
FIG. 7 is an illustration of the bridge plug assembly of FIG. 6, with an exploded view of the tool brake including a pad assembly, according to principles of the disclosure.

FIG. 7 is an illustration of the bridge plug assembly 155 of FIG. 6, with an exploded view of the tool brake 200, according to principles of the disclosure. The tool brake 200 comprises a pad assembly 210 having a first end 211*a* configured to engage with the second connecting mechanism 122 of the lower portion 119 of the setting tool 120. The first end 211*a* may comprise a threaded connecting mechanism. The pad assembly 210 also has a second end 212 configured to engage with a first end 216 of bridge plug adapter 215. The second end 212 of the pad assembly 210 and the first end 216 of bridge plug adapter 215 may be threaded connecting mechanisms for engaging one another. A second end 217 is connectable to the bridge plug 110 via connecting mechanism 124. Moreover, bridge plug adapter 215 may be bridge plug adapter 116. Bridge plug adapter 215 is insertable into setting sleeve 115 for connecting to the pad assembly 210 of the tool brake 200.

The tool brake 200 includes a tool brake housing 203 configured to receive the pad assembly 210 therewithin. The tool brake housing 203 may be of a tubular shape with an inner circumference. First end 211*a* may also be configured as a circular ring with an outer circumference forming a guide. Mid-section ring 211*b* may also be configured as a ring having an outer circumference configured more towards the second end 212 also forming a guide. The outer circumferences of first end 211*a* and mid-section ring 211*b* may be sized to permit insertion into the tool brake housing 203 mating with the inner circumference of the tool brake housing 201 for guiding and aligning the pad assembly 210 within the tool brake housing 203 when assembled. The tool brake housing 203 may have a first end 201 and a second end 202. The first end 201 is configured to connect with the setting tool 120 via connecting mechanism 121. The second end 202 is configured to connect with setting sleeve 115, such as via threaded connections. Tool brake housing 203 is configured with one or more windows 205 positioned about a circumference of the tool brake housing 203 that permit the one or more extendable pad arms 220 (FIG. 8) to dynamically align with the one or more windows 205 in operation, as explained more fully below.

Figure 8:
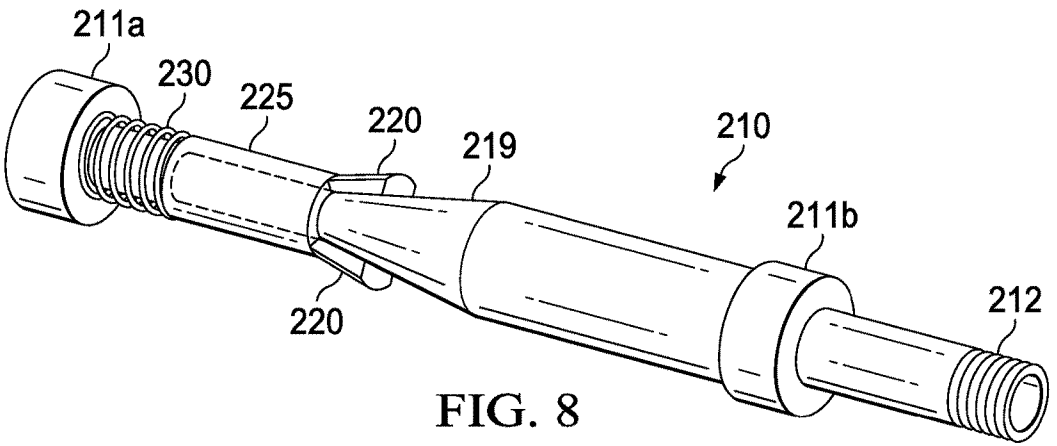
FIG. 8 is a close-up view of the pad assembly of FIG. 7.

FIG. 8 is a close-up view of the pad assembly 210 of FIG. 7. One or more pressure mechanisms such as one or more extendable pad arms 220, which may be a plurality of extendable pad arms, are configured along a portion of the pad assembly 210 that in operation can be propelled by an actuating mechanism such as a spring 230 against a shaft 225 causing the one or more extendable pad arms 220 to extend outwardly through respectively aligned windows 205 upon activation of the setting tool 120. The actuating mechanism 230 can be positioned against a face of an elevated surface associated with the first end 211*a*. The plurality of extendable pad arms 220 may be positioned to move upwardly along a conical portion 219 of the pad assembly. In one embodiment, the conical portion 219 is configured between first end 211*a* and mid-section ring 211*b*.

Figure 9:
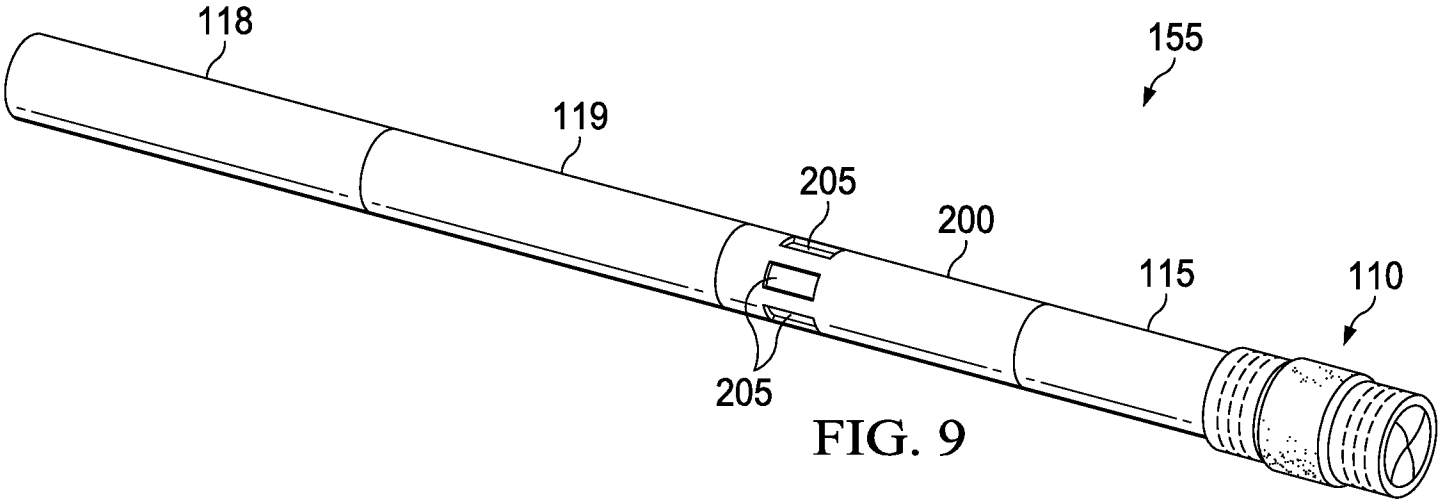
FIG. 9 is an illustration of an assembled bridge plug assembly of FIG. 7.

FIG. 9 is an illustration of an assembled bridge plug assembly 155 of FIG. 7. In FIG. 9, the one or more extendable pad arms 220 are held in a non-extended position, i.e., a closed position, within the tool brake housing 203 due to the non-aligned of the one or more extendable pad arms 220 with the windows 205.

Figure 10:
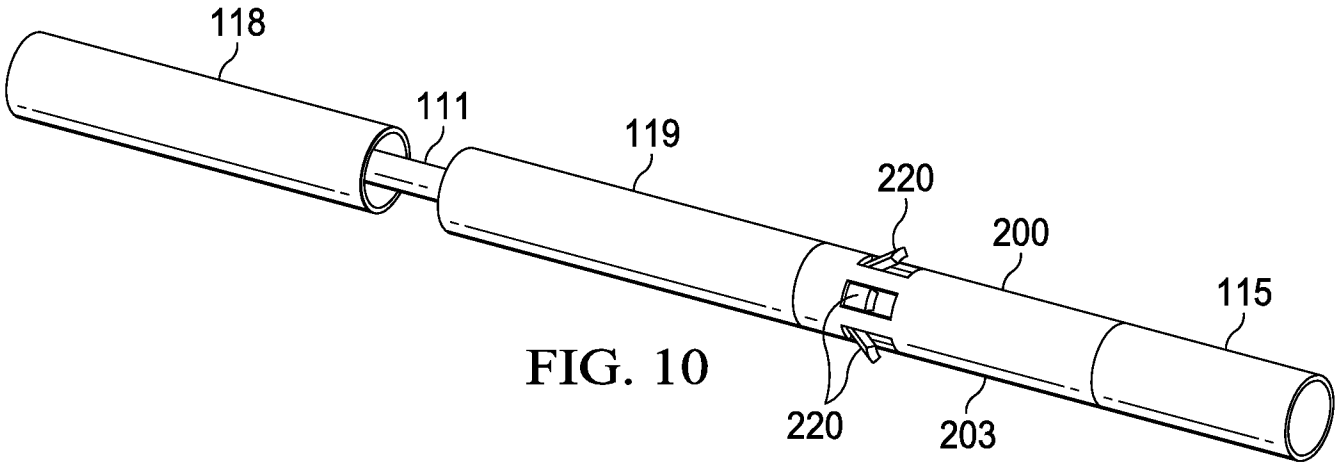
FIG. 10 is an illustration of the bridge plug assembly of FIG. 9, after bridge plug placement, according to principles of the disclosure.

FIG. 10 is an illustration of the bridge plug assembly of FIG. 9, after bridge plug 110 placement, according to principles of the disclosure. A plurality of extendable pad arms 220 is shown extended, i.e., into an open position, through windows 220 due to activation of the setting tool 120 which caused the piston 111 to push the lower section 119 of the setting tool 120 to sever and set bridge plug 110 in the wellbore casing 105, and also to move tool housing 203 or the plurality of extendable pad arms 220 relative to one another to thereby align the plurality of extendable pad arms 220 with respective windows 220. The plurality of extendable pad arms 220 may extend through the plurality of windows for providing a lateral force to the wellbore casing simultaneously or near simultaneously with the setting and severing of the bridge plug 110.

This alignment permits the plurality of extendable pad arms 220 to extend outwardly against the wellbore casing 105. The plurality of extendable pad arms 220 exert sufficient pressure against the wellbore casing 105 to hold the remaining components of the tool string 135' (FIG. 11) in place within the wellbore casing 105 to resist slippage due to gravity. The extension of the plurality of extendable pad arms 220 themselves is not depended on any forces provided by or initiated at the surface, other than to activate the setting tool 120 which causes alignment of the windows 205 and the plurality of extendable pad arms 220 relative to one another. In one embodiment, the amount of force that the plurality of extendable pad arms 220 exerts against the wellbore casing 105 is a function of the amount of force that can be supplied by the local actuating mechanism, such as spring 230, itself, that translates to an amount of lateral force against the wellbore casing 105 by the plurality of extendable pad arms 220. In embodiments, different actuating mechanisms may be used, each capable of providing a different amount of lateral force, which may be related to the type of tool string being deployed in the well. In embodiments, the amount of lateral force being supplied by the local actuating mechanism does not depend on the amount of force, such as hydraulic pressure, being supplied from the surface. Instead, in some embodiments, the lateral force exerted by the plurality of extendable pad arms 220 is due only to the local action and force capacity of the local actuating mechanism, such as spring 230. The plurality of extendable pad arms 220 can be extended as propelled by a local actuating mechanism, such as a spring 230, once the windows 205 and the plurality of extendable pad arms 220 align relative to one another. Alternatively, instead of a spring 230, a hydraulic force could be created within the tool brake 200 that could put pressure on the plurality of extendable pad arms 220 that forces the plurality of extendable pad arms 220 out of respective aligned windows 205.

In one embodiment, the force being applied by the plurality of extendable pad arms 220 against the wellbore casing 105 is not determined by the amount of tension or pressure being applied to the tool string 135' itself. The tool brake 200 has basically two positions, open and closed. The tool brake is closed, i.e., the plurality of extendable pad arms 220 are not extended, while the tool brake is being run into the well 102, and open when the tool is operated for maintaining position or when being pulled out of the well 102. The tool brake 200 is adapted to be inserted between the setting tool 120 and the setting sleeve 115. The setting tool 120 and the setting sleeve 115 may be traditional devices. When inserted between the setting tool 120 and the setting sleeve 115, the travel used to set a bridge plug can also be used to activate an actuating mechanism, such as spring 230, that extends the plurality of extendable pad arms 220, or similar apparatus, against the wellbore casing 105 through windows 220. The plurality of extendable pad arms 220 increase drag and prevents slippage of the tool string 135'. Eliminating slippage provides increased accuracy of tool placement within the wellbore 105. Moreover, eliminating slippage eliminates inadvertent overrun and cutting of cable 170, such as when perforating guns are detonated **125*a*-125*c***.

FIG. 11 is an illustration of an example drilling system 100 including tool string 135' within a well 102, according to principles of the disclosure. Tool string 135' includes tool brake 200 with a plurality of extendable pad arms 220 extended through windows 205 to hold the tool string 135' in place. Bridge plug 110 is shown already severed from the tool string 135' and expanded in wellbore casing 105, due to activation of setting tool 120. Placement of tools, such as the perforating guns **125*a*-125*c*, can now be better controlled because the tension of the extended plurality of extendable pad arms 220 against the wellbore casing 105 is sufficient to prevent uncontrolled or accelerated slippage in direction R, but also permits controlled movement and placement of the tools, such as the perforating guns 125*a*-125*c*, by pulling the cable 170 upwardly towards the surface with a force sufficient to overcome the pressure being exerted by the extended plurality of extendable pad arms 220 against the wellbore casing 105. In this manner, controlled placement of tools, such as the perforating guns 125*a*-125*c*, at a desired depth within wellbore casing 105 is more reliable. The length of cable 130' provides location information as to the position of tool string 135' in wellbore casing 105**.

Moreover, tool string 135' can be removed from the well 102 by exerting sufficient force on cable 130' to overcome the pressure being exerted by the plurality of extendable pad arms 220. Tool string 135' can be removed after the perforating guns **125*a*-125*c* are detonated to puncture the wellbore casing 105. This technique prevents tool string 135' from moving in an uncontrolled fashion in direction R because of gravity, and also prevents inadvertent cutting of the cable 130', such as due to a situation where the perforating guns 125*a*-125*c* move onto or over the cable 130'** prior to detonation.

Figure 12:
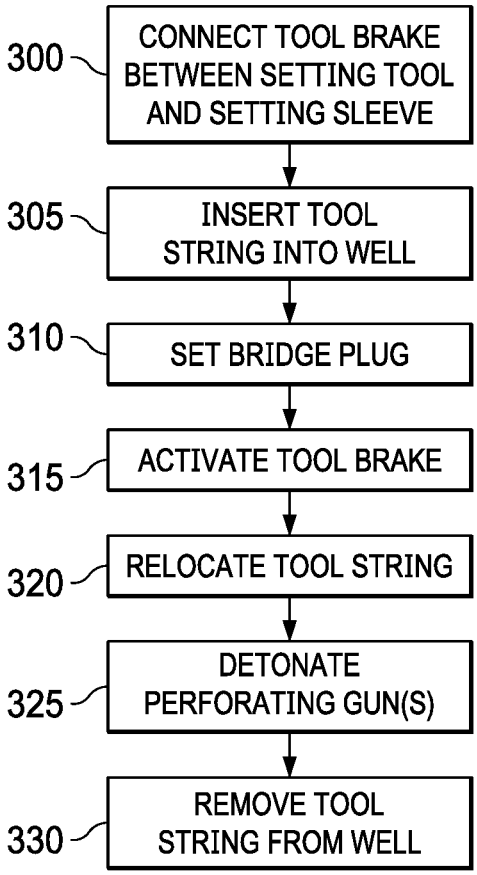
FIG. 12 is a flow diagram showing an example process for using the tool brake of FIGS. 6-11, according to principles of the disclosure.

FIG. 12 is a flow diagram showing an example process for using the tool brake of FIGS. 6-11, according to principles of the disclosure. At step 300, the tool brake 200 is connected between a setting tool 120 and a setting sleeve 115, as part of a tool string 135'. The tool string 135' may include one or more preformatting guns 125 and a bridge plug 110. The tool string 135' may include other tools. At step 305, the tool string may be inserted into a well 102. At step 310, the bridge plug 110 may be set at a desired depth within well casing 105. Step 310 includes severing the bridge plug 110 from the tool string 135'. At step 315, the tool brake 200 is activated. The tool brake 200 is activated simultaneous, or near simultaneous, with the setting of the bridge plug 110 in step 310, as the same action of the setting tool 120 sets the bridge plug and also activates the tool brake 200. At step 320, the tool string 135' may be repositioned within wellbore casing 105 by pulling the tool string 135' towards the surface 165 by cable 130'. The lateral force of the at least one arm 220 of the tool brake 200 against the well bore casing 105 inhibits slippage of the tool string 135' at the repositioned location. At step 325, the at least one perforating gun 125 may be detonated, based on operational decisions. At step 330, the tool string 135' may be pulled from the well 102 by exerted sufficient force on cable 130' to overcome the tool brake holding force against the wellbore casing 105.

This process of FIG. 12 also prevents undesired slippage of a tool string 135' including at least one perforating gun 125 in a reverse direction R (FIG. 11). This process also prevents the cable 130' from being inadvertently over-run by the tool string 135' since the tool string 135' may travel faster due to the pull of gravity as compared to speed provided by the pull of the cable 130'. This in turn prevents the cable 130' from being accidentally cut, when the perforating guns are detonated.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1: a tool brake for use with a tool string positionable in a horizontal well comprising a tool brake housing having a first end and a second end, the housing configured to receive a pad assembly therewithin and configured with a plurality of windows, and the pad assembly having a plurality of arms operatively extendable from a closed position to an open positon through the plurality of windows for providing a lateral force to a wellbore casing to resist slippage of the tool string.

Clause 2: the tool brake of clause 1, wherein the pad assembly extends the plurality of arms due to the plurality of windows operatively aligning with the plurality of windows.

Clause 3: the tool brake of clause 1 or 2, wherein the tool brake housing or the pad assembly is configured to move in relation to the other to operatively align the plurality of arms with the plurality of windows thereby permitting the plurality of arms to extend through the plurality of windows.

Clause 4: the tool brake of clause 1, wherein the tool brake is attachable at the first end to a setting tool and the tool brake is attachable at the second end to a setting sleeve.

Clause 5: the tool brake of any one of clauses 1-3, wherein the pad assembly comprises an actuating mechanism to extend the plurality of arms thereby providing the lateral force against the wellbore casing.

Clause 6: the tool brake of clause 5, wherein the actuating mechanism generates the lateral force solely from within the tool brake housing.

Clause 7: the tool brake of clauses 5 or 6, wherein the actuating mechanism comprises a spring.

Clause 8: the tool brake of any one of clauses 5-7, wherein the pad assembly has a first end connectable to a lower portion of a setting tool, and the pad assembly has a second end connectable to a bridge plug adapter.

Clause 9: the tool brake of any one of clauses 1-8, wherein the plurality of arms operatively extend through the plurality of windows for providing a lateral force to the wellbore casing simultaneously with a setting of a bridge plug.

Clause 10, the tool brake of any one of clauses 1-9, wherein the pad assembly includes a plurality of circular guides to position the pad assembly within the tool brake housing.

Clause 11: a method for positioning a tool string in a horizontal well comprising:

connecting a tool brake between a setting tool and a setting sleeve as part of a tool string, the tool string including a bridge plug;

inserting the tool string into a wellbore;

setting the bridge plug; and activating the tool brake causing at least one arm to extend through at least one window in a housing of the tool brake to provide a lateral force against a wellbore casing thereby inhibiting slippage of the tool string within the wellbore casing.

Clause 12: the method of clause 11, wherein the step of setting is simultaneous or near simultaneous with the step of activating.

Clause 13: the method of clauses 11 or 12, wherein the step of setting causes the step of activating.

Clause 14: the method of clauses 11, 12 or 13, wherein in the step of connecting the tool brake, the tool brake comprises the housing having a first end and a second end, the housing configured to receive a pad assembly therewithin and the housing configured with at least one window about a circumference of the housing.

Clause 15: the method of clause 14, wherein in the step of activating, the at least one arm extends from a closed position to an open positon through the at least one window thereby providing a lateral force to a wellbore casing to resist slippage of the tool string in the wellbore casing.

Clause 16: the method of clauses 14 or 15, wherein in the step of activating, the housing or the pad assembly moves in relation to the other to align the at least one window with the at least one arm thereby permitting the at least one arm to extend through the at least one window.

Clause 17: the method of any one of clauses 11-16, wherein in the step of activating, an actuating mechanism located within the housing causes the at least one arm to extend.

Clause 18: the method of any one of clauses 11-17, wherein after the steps of setting and activating, further comprising repositioning the tool string within the wellbore by exerting a force on the tool string greater than the lateral force against the wellbore casing to pull the tool string along the wellbore casing.

Clause 19: the method of clause 18, wherein the tool string includes at least one perforating gun and the repositioning includes repositioning the at least one perforating gun within the wellbore casing, and the lateral force against the wellbore casing by the at least one arm inhibits slippage of the at least one preformatting gun at a repositioned location.

Clause 20: the method of any one of clauses 11-19, wherein the step of connecting includes connecting the tool brake at the first end to the setting tool and connecting the tool brake at a second end to the setting sleeve, and the step of setting includes severing the bridge plug from the tool string.

While this specification provides specific details related to a tool brake for tool placement in wells, it may be appreciated that the list of components is illustrative only and is not intended to be exhaustive or limited to the forms disclosed. The scope of the claims is intended to broadly cover the disclosed components and any such components that are apparent to those of ordinary skill in the art.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A tool brake for use with a tool string positionable in a horizontal well comprising:

a tool brake housing having a first end and a second end, the housing configured to receive pad assembly therewithin and configured with a plurality of windows; and a pad assembly having a plurality of arms operatively extendable from a closed position to an open position through the plurality of windows for providing a lateral force to a wellbore casing to resist slippage of the tool string;

wherein the tool brake is configured to operatively extend the plurality of arms through the plurality of windows simultaneously with the setting of a bridge plug; and when the tool string is repositioned in the horizontal well, a force is exerted on the tool string greater than the lateral force of the engaged tool brake against the wellbore casing so as to pull the tool string along the wellbore casing; wherein the lateral force of the tool brake against the wellbore casing inhibits slippage of the tool string when the tool string is repositioned while the tool brake is engaged.

2. The tool brake of claim 1, wherein the pad assembly is configured to extend the plurality of arms through the plurality of windows when operatively aligned with the plurality of windows.

3. The tool brake of claim 1, wherein the tool brake housing or the pad assembly is configured to move in relation to the other to operatively align the plurality of arms with the plurality of windows thereby permitting the plurality of arms to extend through the plurality of windows.

4. The tool brake of claim 1, wherein the tool brake is attachable at the first end to a setting tool and the tool brake is attachable at the second end to a setting sleeve.

5. The tool brake of claim 1, wherein the pad assembly comprises an actuating mechanism to extend the plurality of arms thereby providing the lateral force against the wellbore casing.

6. The tool brake of claim 5, wherein the actuating mechanism generates the lateral force solely from within the tool brake housing.

7. The tool brake of claim 5, wherein the actuating mechanism comprises a spring.

8. The tool brake of claim 5, wherein the pad assembly has a first end connectable to a lower portion of a setting tool, and the pad assembly has a second end connectable to a bridge plug adapter.

9. The tool brake of claim 1, wherein the pad assembly includes a plurality of circular guides to position the pad assembly within the tool brake housing.

10. A method for positioning a tool string in a horizontal well comprising:

connecting a tool brake between a setting tool and a setting sleeve as part of a tool string, the tool string including a bridge plug;

inserting the tool string into a wellbore;

setting the bridge plug; and activating the tool brake causing at least one arm to extend through at least one window in a housing of the tool brake to provide a lateral force against a wellbore casing thereby inhibiting slippage of the tool string within the wellbore casing.

11. The method of claim 10, wherein the step of setting is simultaneous or near simultaneous with the step of activating.

12. The method of claim 10, wherein the step of setting causes the step of activating.

13. The method of claim 10, wherein in the step of connecting the tool brake, the tool brake comprises the housing having a first end and a second end, the housing configured to receive a pad assembly therewithin and the housing configured with at least one window about a circumference of the housing.

14. The method of claim 13, wherein in the step of activating, the at least one arm extends from a closed position to an open position through the at least one window thereby providing a lateral force to a wellbore casing to resist slippage of the tool string in the wellbore casing.

15. The method of claim 13, wherein in the step of activating, the housing or the pad assembly moves in relation to the other to align the at least one window with the at least one arm thereby permitting the at least one arm to extend through the at least one window.

16. The method of claim 10, wherein in the step of activating, an actuating mechanism located within the housing causes the at least one arm to extend.

17. The method of claim 10, wherein after the steps of setting and activating, further comprising repositioning the tool string within the wellbore by exerting a force on the tool string greater than the lateral force against the wellbore casing to pull the tool string along the wellbore casing.

18. The method of claim 17, wherein the tool string includes at least one perforating gun and the repositioning includes repositioning the at least one perforating gun within the wellbore casing, and the lateral force against the wellbore casing by the at least one arm inhibits slippage of the at least one preformatting gun at a repositioned location.

19. The method of claim 10, wherein the step of connecting includes connecting the tool brake at a first end to the setting tool and connecting the tool brake at a second end to the setting sleeve, and the step of setting includes severing the bridge plug from the tool string.

* * * * *